US011963546B2

(12) United States Patent
Moreno Rodríguez et al.

(10) Patent No.: US 11,963,546 B2
(45) Date of Patent: Apr. 23, 2024

(54) AEROSOL GENERATING ARTICLES AND METHODS FOR MANUFACTURING THE SAME

(71) Applicant: JT International S.A., Geneva (CH)

(72) Inventors: Juan José Moreno Rodríguez, Geneva (CH); Mark Gill, London (GB)

(73) Assignee: JT International S.A. (CH)

( * ) Notice: Subject to any disclaimer, the term of this patent is extended or adjusted under 35 U.S.C. 154(b) by 629 days.

(21) Appl. No.: 17/055,839

(22) PCT Filed: Jun. 8, 2018

(86) PCT No.: PCT/EP2018/065155
§ 371 (c)(1),
(2) Date: Nov. 16, 2020

(87) PCT Pub. No.: WO2019/223886
PCT Pub. Date: Nov. 28, 2019

(65) Prior Publication Data

US 2021/0227878 A1 Jul. 29, 2021

(30) Foreign Application Priority Data

May 21, 2018 (EP) ..... 18173398
May 21, 2018 (EP) ..... 18173404
May 21, 2018 (EP) ..... 18173406

(51) Int. Cl.
*A24D 1/20* (2020.01)
*A24C 5/01* (2020.01)
(Continued)

(52) U.S. Cl.
CPC ..... *A24C 5/01* (2020.01); *A24D 1/02* (2013.01); *A24D 1/20* (2020.01); *A24F 40/20* (2020.01); *A24F 40/465* (2020.01)

(58) Field of Classification Search
None
See application file for complete search history.

(56) References Cited

U.S. PATENT DOCUMENTS 5,065,776 A 11/1991 Lawson et al.
5,129,409 A 7/1992 White et al.
(Continued)

FOREIGN PATENT DOCUMENTS

CN 203353674 U 12/2013
CN 105939624 A 9/2016
(Continued)

OTHER PUBLICATIONS

International Search Report including Written Opinion for Application No. PCT/EP2018/065155 dated Jan. 23, 2019; 12 pages.
(Continued)

*Primary Examiner* — Dennis R Cordray
(74) *Attorney, Agent, or Firm* — Lerner David LLP

(57) ABSTRACT

An aerosol generating article includes a first body of aerosol forming material, a first tubular member surrounding the first body of aerosol forming material which is inductively heatable in the presence of a time varying electromagnetic field, a second body of aerosol forming material surrounding the first tubular member and a second tubular member surrounding the second body of aerosol forming material. The second body of aerosol forming material includes at least one sheet of aerosol forming material wrapped around the first tubular member and/or the second body of aerosol forming material includes foam material and/or at least part of the second body of aerosol forming material is adhered to the first tubular member and/or the second tubular member. Methods for manufacturing aerosol generating articles are also described.

17 Claims, 6 Drawing Sheets

(51) Int. Cl.

| | |
|---|---|
| ***A24D 1/02*** | (2006.01) |
| ***A24F 40/20*** | (2020.01) |
| ***A24F 40/465*** | (2020.01) |

(56) References Cited

U.S. PATENT DOCUMENTS

| | | | |
|---|---|---|---|
| 5,611,360 | A | 3/1997 | Tang |
| 5,954,060 | A | 9/1999 | Cardarelli |
| 6,161,552 | A | 12/2000 | Case et al. |
| 2007/0137667 | A1 | 6/2007 | Zhuang et al. |
| 2013/0306085 | A1 | 11/2013 | Sanchez et al. |
| 2014/0020698 | A1 | 1/2014 | Fiebelkom |
| 2014/0299142 | A1 | 10/2014 | Dincer et al. |
| 2015/0157052 | A1 | 6/2015 | Ademe et al. |
| 2017/0055575 | A1 | 3/2017 | Wilke et al. |
| 2017/0055581 | A1 | 3/2017 | Wilke et al. |
| 2017/0055582 | A1 | 3/2017 | Blandino et al. |
| 2017/0119049 | A1 | 5/2017 | Blandino et al. |
| 2018/0192700 | A1 | 7/2018 | Fraser et al. |
| 2018/0338520 | A1 | 11/2018 | Sutton et al. |
| 2021/0084981 | A1 | 3/2021 | Rogan et al. |
| 2021/0153555 | A1 | 5/2021 | Gill |
| 2021/0227877 | A1 | 7/2021 | Brvenik |

FOREIGN PATENT DOCUMENTS

| | | | |
|---|---|---|---|
| CN | 107373749 | A | 11/2017 |
| CN | 107373761 | A | 11/2017 |
| CN | 107427088 | A | 12/2017 |
| CN | 107708453 | A | 2/2018 |
| CN | 107920600 | A | 4/2018 |
| CN | 107949285 | A | 4/2018 |
| JP | 2014-511675 | A | 5/2014 |
| JP | 5976637 | B2 | 8/2016 |
| JP | 2021523707 | A | 9/2021 |
| JP | 2021524237 | A | 9/2021 |
| JP | 2021524239 | A | 9/2021 |
| KR | 100259781 | B1 | 6/2000 |
| WO | 12011139730 | A1 | 11/2011 |
| WO | 2018002083 | A1 | 1/2018 |
| WO | 2018002084 | A1 | 1/2018 |

OTHER PUBLICATIONS

International Search Report including Written Opinion for Application No. PCT/EP2019/062473 dated Sep. 11, 2019, 12 pages.

Search Report dated Apr. 11, 2022 from the Office Action for Chinese Application No. 201880093592.2, dated Apr. 15, 2022, pp. 1-2.

AEROSOL GENERATING ARTICLES AND METHODS FOR MANUFACTURING THE SAME

CROSS-REFERENCE TO RELATED APPLICATIONS

The present application is a national phase entry under 35 U.S.C. § 371 of International Application No. PCT/EP2018/065155, filed Jun. 8, 2018, published in English, which claims priority to European Application No. 18173398.1 filed May 21, 2018, European Application No. 18173404.7 filed May 21, 2018, and European Application No. 18173406.2 filed May 21, 2018, the disclosures of which are incorporated herein by reference.

TECHNICAL FIELD

The present disclosure relates generally to aerosol generating articles, and more particularly to an aerosol generating article for use with an aerosol generating device for heating the aerosol generating article to generate an aerosol for inhalation by a user. Embodiments of the present disclosure also relate to methods for manufacturing an aerosol generating article.

TECHNICAL BACKGROUND

Devices which heat, rather than burn, an aerosol forming material to produce an aerosol for inhalation have become popular with consumers in recent years.

Such devices can use one of a number of different approaches to provide heat to the aerosol forming material. One such approach is to provide an aerosol generating device which employs an induction heating system and into which an aerosol generating article, comprising aerosol forming material, can be removably inserted by a user. In such a device, an induction coil is provided with the device and an induction heatable susceptor is provided with the aerosol generating article. Electrical energy is provided to the induction coil when a user activates the device which in turn generates an alternating electromagnetic field. The susceptor couples with the electromagnetic field and generates heat which is transferred, for example by conduction, to the aerosol forming material and an aerosol is generated as the aerosol forming material is heated.

The characteristics of the aerosol generated by the aerosol generating device are dependent upon a number of factors, including the construction of the aerosol generating article used with the aerosol generating device. There is, therefore, a desire to provide an aerosol generating article which enables the characteristics of the aerosol generated during use of the article to be optimised and to provide methods which facilitate the manufacture of the aerosol generating article.

SUMMARY OF THE DISCLOSURE

According to a First Aspect of the Present Disclosure, there is Provided an Aerosol Generating Article Comprising:

- a first body of aerosol forming material;
- a first tubular member surrounding the first body of aerosol forming material, the first tubular member being inductively heatable in the presence of a time varying electromagnetic field;
- a second body of aerosol forming material surrounding the first tubular member;

- a second tubular member surrounding the second body of aerosol forming material;
- wherein the second body of aerosol forming material includes at least one sheet of aerosol forming material wrapped around the first tubular member and/or wherein the second body of aerosol forming material includes foam material and/or wherein at least part of the second body of aerosol forming material is adhered to the first tubular member and/or the second tubular member.

The aerosol generating article is for use with an aerosol generating device for heating the aerosol forming material, without burning the aerosol forming material, to volatise at least one component of the aerosol forming material and thereby generate an aerosol for inhalation by a user of the aerosol generating device.

The aerosol generating article is easy to manufacture due to the provision of the at least one sheet of aerosol forming material wrapped around the first tubular member and/or the use of foam material and/or the adherence of at least part of the second body of aerosol forming material to the first tubular member and/or the second tubular member.

The provision of an inductively heatable first tubular member provides for optimum heat transfer from the inductively heatable first tubular member to both the first and second bodies of aerosol forming material. This in turn provides for optimum heating of the first and second bodies of aerosol forming material and ensures that the characteristics of the aerosol generated during use of the article are optimised.

The at least one sheet of aerosol forming material may include one or more surface projections and/or one or more surface recesses to form an air flow path through the aerosol generating article. Thus, air can easily flow through the aerosol generating article thereby ensuring that an aerosol with optimum characteristics is generated during use of the aerosol generating article with an aerosol generating device. The one or more surface projections and/or the one or more surface recesses may be provided on a radially inner surface of the at least one sheet of aerosol forming material and/or on a radially outer surface of the at least one sheet of aerosol forming material.

The second body of aerosol forming material may include a plurality of layers between the first and second tubular members. The provision of a plurality of overlapping circumferential layers may increase the amount of aerosol that is generated during use of the aerosol generating article with an aerosol generating device. The aerosol generating article may comprise a single sheet of aerosol forming material wrapped multiple times around the first tubular member to provide the plurality of layers. The aerosol generating article may comprise a plurality of sheets of aerosol forming material wrapped around the first tubular member so that each wrapped sheet provides one of the plurality of layers.

One of the layers may be adhered to the first tubular member. Another of the layers may be adhered to the second tubular member. Adhering one of the layers to the first tubular member and/or adhering another of the layers to the second tubular member ensures that the aerosol generating article has good structural integrity.

The first tubular member may comprise a wrapper formed of an inductively heatable susceptor material. For example, the first tubular member may comprise a metal wrapper. With the application of a time varying electromagnetic field in its vicinity, heat is generated in the inductively heatable susceptor material due to eddy currents and magnetic hysteresis losses resulting in a conversion of energy from electromagnetic to heat. By forming the first tubular member of an inductively heatable susceptor material, eddy currents are advantageously generated throughout the first tubular member, ensuring that the first tubular member is uniformly heated and thereby ensuring uniform heating of the aerosol forming material.

The inductively heatable susceptor material may comprise one or more, but not limited, of aluminium, iron, nickel, stainless steel and alloys thereof, e.g. Nickel Chromium or Nickel Copper.

The wrapper may have longitudinally extending free edges, for example overlapping free edges, which may be secured together using an electrically conductive adhesive.

The first tubular member may comprise a wrapper formed of a material that is substantially non-electrically conductive and non-magnetically permeable, for example a paper wrapper, and at least one track of electrically conductive material extending circumferentially around the wrapper to form a closed circuit. The first tubular member may include a plurality of said electrically conductive tracks at axially spaced positions along the wrapper, with each track forming a closed circuit. The electrically conductive tracks are inductively heated during use of the aerosol generating article and heat is transferred from the electrically conductive tracks to the aerosol forming material.

The or each electrically conductive track may be mounted on an inner surface of the wrapper or on an outer surface of the wrapper. In embodiments which employ a plurality of axially spaced electrically conductive tracks, the electrically conductive tracks may be mounted on both the inner and outer surfaces of the wrapper. For example axially adjacent electrically conductive tracks may be mounted in an alternating and repeating manner on the inner and outer surfaces respectively of the wrapper.

The second tubular member may comprise a material which is substantially non-electrically conductive and non-magnetically permeable. The second tubular member may comprise a wrapper and may, for example, comprise a paper wrapper. The wrapper may have longitudinally extending free edges, for example overlapping free edges, which may be secured together using an adhesive which may also be substantially non-electrically conductive and non-magnetically permeable.

The aerosol generating article may be elongate and the axial ends of the first body of aerosol forming material, the second body of aerosol forming material and the first tubular member may be axially aligned. This arrangement provides for optimal heating of the aerosol forming material by the inductively heatable first tubular member as the first tubular member extends over entire length of the aerosol forming material.

The first and second tubular members may be substantially concentric. The construction of the aerosol generating article is thereby simplified.

As noted above, the aerosol generating article may be elongate and may be substantially cylindrical. The cylindrical shape of the aerosol generating article with its circular cross-section may advantageously facilitate insertion of the aerosol generating article into a heating compartment of an induction heating assembly of an aerosol generating device in which the induction heating assembly includes a helical induction coil having a circular cross-section.

The aerosol generating article may further comprise an air-permeable plug at an axial end thereof. The air-permeable plug could comprise cellulose acetate fibres. The air-permeable plug may advantageously retain the first body of aerosol forming material inside the first tubular member and the second body of aerosol forming material between the first and second tubular members. The aerosol generating article may include a first one of said air-permeable plugs at a first axial end thereof and a second one of said air-permeable plugs at a second axial end thereof. The provision of first and second air-permeable plugs may provide improved retention of the first and second bodies of aerosol forming material. In addition, because the first tubular member acts as an inductively heatable susceptor, the first and second bodies of aerosol forming material are heated during use of the article without it being necessary to penetrate the first or second air-permeable plugs with a heating element of an aerosol generating device.

The aerosol forming material of the first and second bodies may be any type of solid or semi-solid material. In addition to granules and pellets as mentioned above, example types of aerosol forming solids include powder, shreds, strands, porous material, foam material or sheets. The aerosol forming material may comprise plant derived material and in particular, the aerosol forming material may comprise tobacco.

The aerosol forming material of the first and second bodies may comprise an aerosol-former. Examples of aerosol-formers include polyhydric alcohols and mixtures thereof such as glycerine or propylene glycol. Typically, the aerosol forming material may comprise an aerosol-former content of between approximately 5% and approximately 50% on a dry weight basis. In some embodiments, the aerosol forming material may comprise an aerosol-former content of approximately 15% on a dry weight basis.

Upon heating, the aerosol forming material may release volatile compounds. The volatile compounds may include nicotine or flavour compounds such as tobacco flavouring.

According to a second aspect of the present disclosure, there is provided a method for manufacturing an aerosol generating article as defined above in which the first and second tubular members comprise first and second sheets respectively and the second body of aerosol forming material includes at least one sheet of aerosol forming material, the method comprising:

(i) wrapping the first sheet around the first body of aerosol forming material to form the first tubular member;
(ii) wrapping the at least one sheet of aerosol forming material around the first tubular member to form the second body of aerosol forming material; and
(iii) wrapping the second sheet around the second body of aerosol forming material to form the second tubular member.

The provision of the second body of aerosol forming material in sheet form may facilitate manufacture of the aerosol generating article.

As noted above, the second body of aerosol forming material may include a single sheet of aerosol forming material. Thus, step (ii) may be performed multiple times to provide a plurality of layers of the at least one sheet of aerosol forming material. Manufacture of the aerosol generating article is thereby further simplified.

According to a third aspect of the present disclosure, there is provided a method for manufacturing an aerosol generating article as defined above in which the first and second tubular members comprise first and second sheets respectively, the method comprising:

(i) wrapping the first sheet around the first body of aerosol forming material to form the first tubular member;
(ii) wrapping the second body of aerosol forming material around the first tubular member; and (iii) wrapping the second sheet around the second body of aerosol forming material to form the second tubular member;

wherein at least part of the second body of aerosol forming material is adhered to the first sheet and/or the second sheet.

Adhering at least part of the second body of aerosol forming material to the first sheet and/or the second sheet may simplify the manufacture of the aerosol generating article whilst at the same time ensuring that the aerosol generating article has good structural integrity. Simplified manufacture and good structural integrity may be achieved in particular if the second body of aerosol generating material is in sheet form. Nevertheless, the second body of aerosol forming material can have other forms, for example it may comprise a particulate material adhered to the first sheet and/or the second sheet or a foam material adhered to the first sheet and/or the second sheet.

The second body of aerosol forming material may be adhered to the second sheet. In this case, steps (ii) and (iii) may be performed simultaneously to wrap the second sheet and second body of aerosol forming material adhered thereto around the first tubular member so that the second body of aerosol forming material is positioned between the first and second tubular members. Manufacture of the aerosol generating article may be simplified with this arrangement.

The second body of aerosol forming material may be adhered to the first sheet. In this case, steps (i) and (ii) may be performed simultaneously to wrap the first sheet and second body of aerosol forming material adhered thereto around the first body of aerosol forming material so that the first tubular member contacts the first body of aerosol forming material. Manufacture of the aerosol generating article may be simplified with this arrangement.

The second body of aerosol forming material may include at least one sheet of aerosol forming material. As noted above, the use of a sheet material simplifies the manufacture of the aerosol generating article and may enhance its structural integrity.

The method may comprise, prior to steps (ii) and (iii), positioning the second body of aerosol forming material on the second sheet, preferably leaving an exposed region along an edge of the second sheet to allow the exposed region to be connected to an opposite edge of the second sheet during step (iii). With this arrangement, the opposite edges of the second sheet can be reliably connected and secured together, for example by an adhesive which may be substantially non-electrically conductive and non-magnetically permeable, thereby simplifying the manufacture of the aerosol generating article. The adhesive could be applied to the exposed region along the edge and/or along the opposite edge of the second sheet prior to connecting the edges during step (iii).

The method may comprise, prior to step (i), positioning the second body of aerosol forming material on the first sheet, preferably leaving an exposed region along an edge of the first sheet to allow the exposed region to be connected to an opposite edge of the first sheet during step (i). With this arrangement, the opposite edges of the first sheet can be reliably connected and secured together, for example by an electrically conductive adhesive, thereby simplifying the manufacture of the aerosol generating article. The electrically conductive adhesive could be applied to the exposed region along the edge and/or along the opposite edge of the first sheet prior to connecting the edges during step (i).

According to a fourth aspect of the present disclosure, there is provided a method for manufacturing an aerosol generating article as defined above in which the first and second tubular members comprise first and second sheets respectively and the second body of aerosol forming material includes foam material, the method comprising:

(i) wrapping the first sheet around the first body of aerosol forming material to form the first tubular member;

(ii) positioning the foam material around the first tubular member; and (iii) wrapping the second sheet around the foam material to form the second tubular member.

The use of foam material may provide a simplified method for manufacturing the aerosol generating article.

Step (ii) may comprise ejecting the foam material from an opening of a nozzle surrounding the first tubular member formed by wrapping the first sheet in step (i). This may provide a particularly convenient way to position the foam material around the first tubular member.

The first tubular member may move in its longitudinal direction from an inside to an outside of the nozzle through the opening during ejection of the foam material from the opening. Such an arrangement may provide a simple and high-speed manufacturing method.

DETAILED DESCRIPTION OF EMBODIMENTS

Embodiments of the present disclosure will now be described by way of example only and with reference to the accompanying drawings.

Figure 1:
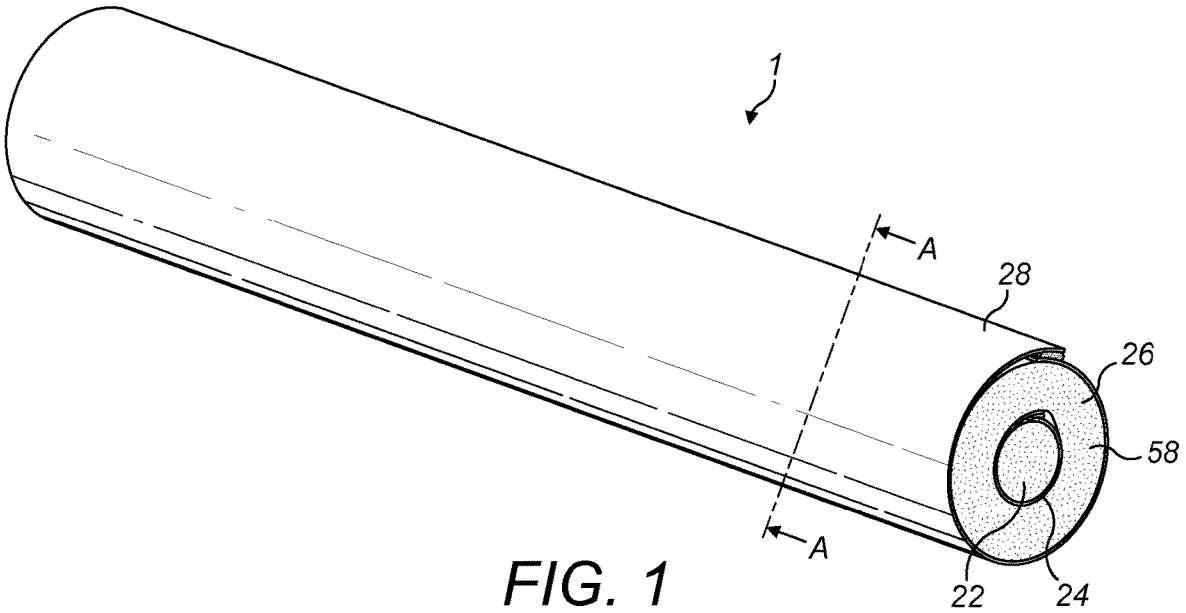
FIG. 1 is a diagrammatic perspective view of a first example of an aerosol generating article.
Figure 2:
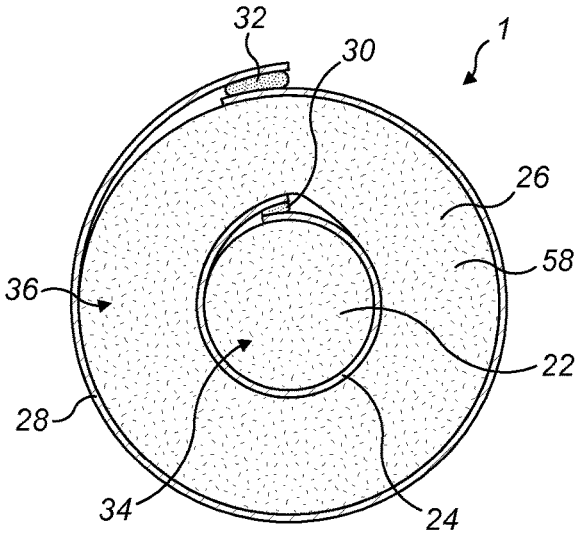
FIG. 2 is a diagrammatic cross-sectional view along the line A-A shown in FIG. 1.

Referring initially to FIGS. 1 and 2, there is shown a first example of an aerosol generating article 1 for use with an aerosol generating device which operates based on the induction heating principle. The aerosol generating article 1 is elongate and substantially cylindrical. The circular cross-section facilitates handling of the article 1 by a user and insertion of the article 1 into a heating compartment of an aerosol generating device.

The article 1 comprises a first body of aerosol forming material 22, a first tubular member 24 surrounding the first body of aerosol forming material 22, a second body of aerosol forming material 26 surrounding the first tubular member 24 and a second tubular member 28 surrounding the second body of aerosol forming material 26.

The first tubular member 24 is inductively heatable in the presence of a time varying electromagnetic field. In the illustrated first example, the first tubular member 24 comprises a metal wrapper formed of an inductively heatable susceptor material. The metal wrapper comprises a single sheet of material, for example a metal foil, having longitudinally extending free edges which are arranged to overlap each other and which are secured together by an electrically conductive adhesive 30. The electrically conductive adhesive 30 typically comprises one or more adhesive components interspersed with one or more electrically conductive components. The metal wrapper and the electrically conductive adhesive 30 together form a closed electrical circuit which surrounds the first body of aerosol forming material 22.

When a time varying electromagnetic field is applied in the vicinity of the metal wrapper during use of the article 1 in an aerosol generating device, heat is generated in the metal wrapper due to eddy currents and magnetic hysteresis losses and the heat is transferred from the metal wrapper to the adjacent first and second bodies of aerosol forming material 22, 26 to heat the aerosol forming material without burning it and to thereby generate an aerosol for inhalation by a user. The metal wrapper constituting the first tubular member 22 is in contact over substantially its entire inner and outer surfaces with at least part of the aerosol forming material of the first and second bodies 22, 26 respectively, thus enabling heat to be transferred directly, and therefore efficiently, from the metal wrapper to the aerosol forming material.

The second tubular member 28 is concentric with the first tubular member 24 and comprises a paper wrapper. Although a paper wrapper may be preferred, the second tubular member 28 can comprise any material which is substantially non-electrically conductive and non-magnetically permeable so that the second tubular member 28 is not inductively heated in the presence of a time varying electromagnetic field during use of the article 1 in an aerosol generating device. The paper wrapper constituting the second tubular member 28 also comprises a single sheet of material having longitudinally extending free edges which are arranged to overlap each other and which are secured together by an adhesive 32 which is substantially non-electrically conductive and non-magnetically permeable so that it is not inductively heated during use of the article 1 in an aerosol generating device.

The first tubular member 24 defines an inner cavity 34 in which the first body of aerosol forming material 22 is positioned and the first and second tubular members 24, 28 define therebetween an annular cavity 36 in which the second body of aerosol forming material 26 is positioned. The first and second bodies of aerosol forming material 22, 26 and the first and second tubular members 24, 28 all have the same axial length and are arranged so that axial ends of the first and second bodies of aerosol forming material 22, 26 are axially aligned with the metal wrapper constituting the first tubular member 24 and with the paper wrapper constituting the second tubular member 28. The first body of aerosol forming material 22 substantially fills the inner cavity 34 and the second body of aerosol forming material 26 substantially fills the annular cavity 36.

The aerosol forming material of the first and second bodies 22, 26 comprises an aerosol-former such as glycerine or propylene glycol. Typically, the aerosol forming material may comprise an aerosol-former content of between approximately 5% and approximately 50% on a dry weight basis. Upon heating due to heat transfer from the metal wrapper constituting the first tubular member 24, the aerosol forming material of both the first and second bodies 22, 26 releases volatile compounds possibly including nicotine or flavour compounds such as tobacco flavouring.

The aerosol forming material of the first body 22 is typically a solid or semi-solid material. Examples of suitable aerosol forming solids include powder, shreds, strands, porous material, foam material and sheets. The aerosol forming material of the second body 26 includes foam material 58. The aerosol forming material of both the first and second bodies 22, 26 typically comprises plant derived material and, in particular, comprises tobacco.

In the article 1 of FIGS. 1 and 2, the first and second bodies of aerosol forming material 22, 26 have the same characteristics, including for example aerosolisation temperature, humectant content, flavour and density. In other embodiments, the first and second bodies of aerosol forming material 22, 26 may have characteristics which differ in at least one or more respects, including aerosolisation temperature, humectant content, flavour and density.

Figure 3:
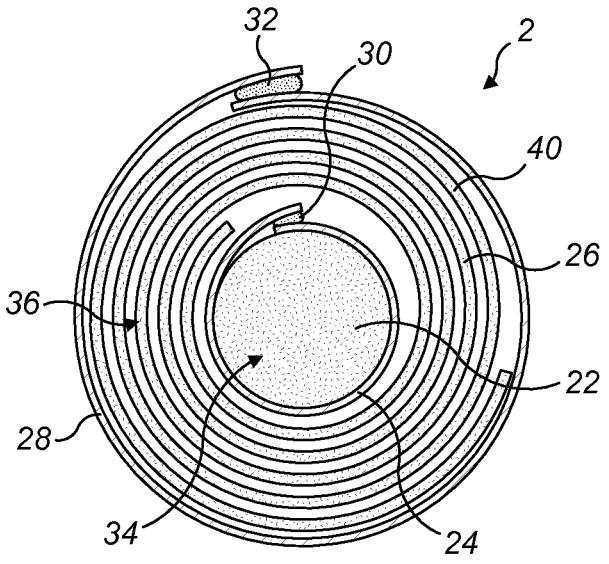
FIG. 3 is a diagrammatic cross-sectional view of a second example of an aerosol generating article similar to the first example shown in FIGS. 1 and 2.

Referring now to FIG. 3, there is shown a diagrammatic cross-sectional view of a second example of an aerosol generating article 2 which is similar to the aerosol generating article 1 illustrated in FIGS. 1 and 2 and in which corresponding elements are designated using the same reference numerals.

The aerosol generating article 2 is identical to the aerosol generating article 1 illustrated in FIGS. 1 and 2 in all respects except that the second body of aerosol forming material 26 is in sheet form, and more particularly comprises a single continuous sheet 40 of aerosol forming material. The sheet 40 of aerosol forming material is wrapped multiple times around the first tubular member 24 to provide a plurality of overlapping circumferential layers of the aerosol forming material between the first and second tubular members 24, 28. The overlapping circumferential layers may be spaced apart slightly in the radial direction as shown in FIG. 3 to provide an air flow path through the aerosol generating article 2. It will be understood by one of ordinary skill in the art that the radial spacing between the overlapping circumferential layers is exaggerated in FIG. 3 for illustration purposes and that adjacent layers may not be fully separated around their entire circumference. In practice, the radial spacing between the overlapping circumferential layers needs to be sufficient to provide an air flow path through the aerosol generating article 2 whilst at the same time ensuring that the aerosol generating article 2 has good structural integrity and can retain its shape.

Figure 4:
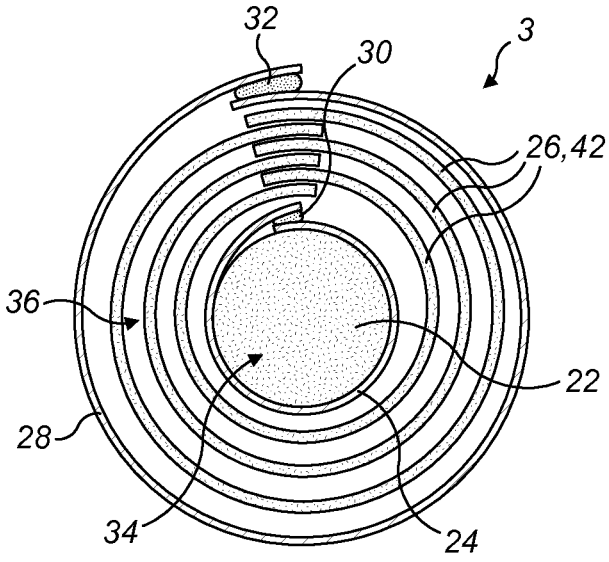
FIG. 4 is a diagrammatic cross-sectional view of a third example of an aerosol generating article similar to the first and second examples shown in FIGS. 1 to 3.

Referring now to FIG. 4, there is shown a diagrammatic cross-sectional view of a third example of an aerosol generating article 3 which is similar to the aerosol generating articles 1, 2 illustrated in FIGS. 1 to 3 and in which corresponding elements are designated using the same reference numerals.

The aerosol generating article 3 is identical to the aerosol generating articles 1, 2 illustrated in FIGS. 1 to 3 in all respects except that the second body of aerosol forming material 26 is in sheet form, and more particularly comprises a plurality of individual sheets 42 of aerosol forming material. Each sheet 42 of aerosol forming material is wrapped once around the first tubular member 24, or an adjacent radially inner sheet 42, so that together the wrapped sheets 42 provide a plurality of overlapping circumferential layers of the aerosol forming material between the first and second tubular members 24, 28. The overlapping circumferential layers may be spaced apart slightly in the radial direction as shown in FIG. 4 to provide an air flow path through the aerosol generating article 3, again noting that the radial spacing is exaggerated in FIG. 4 for illustration purposes in the same way as in FIG. 3.

Figure 5:
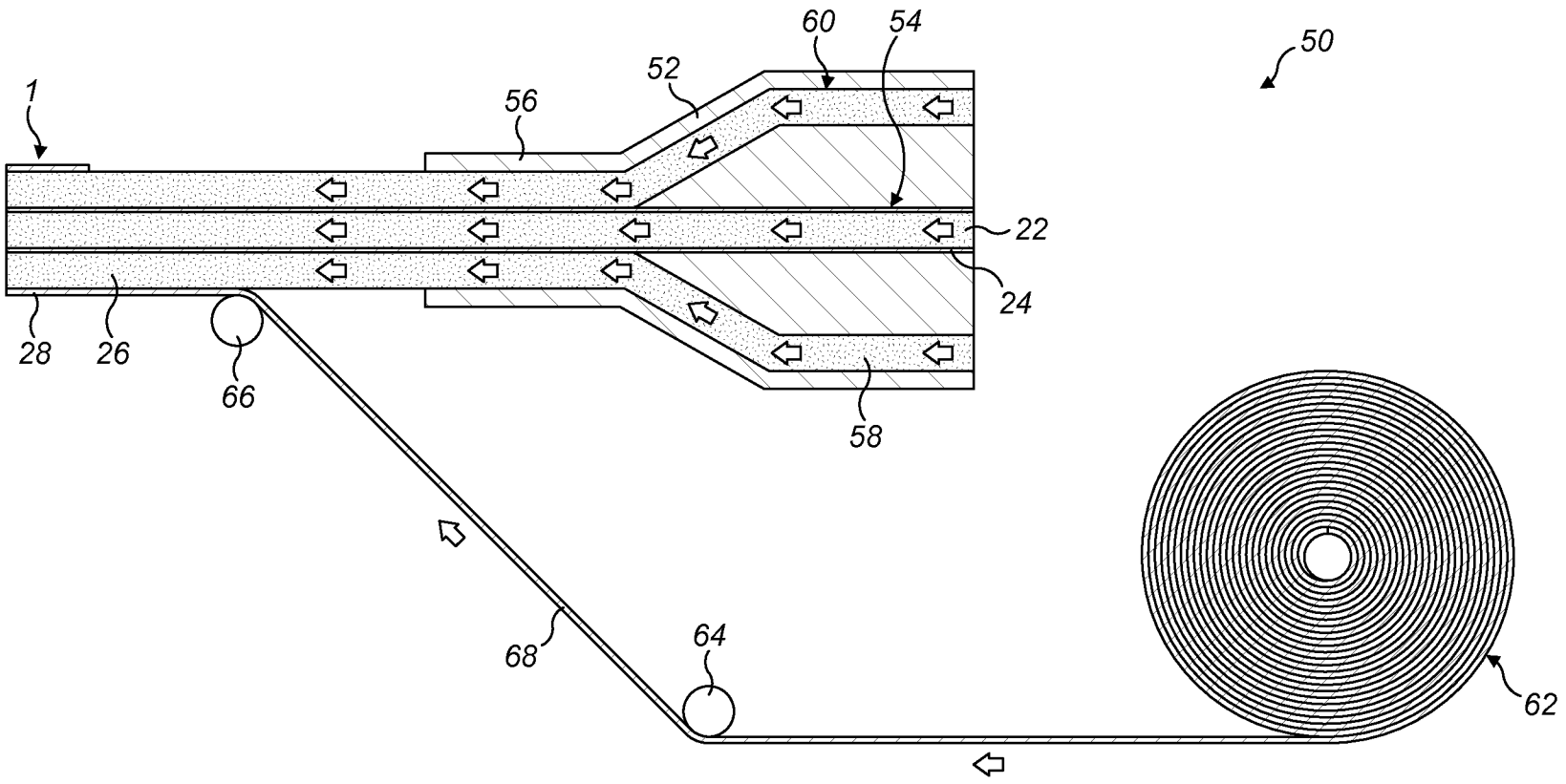
FIG. 5 is a diagrammatic illustration of an apparatus and method for manufacturing the first example of the aerosol generating article illustrated in FIGS. 1 and 2.

Referring now to FIG. 5, there is shown a diagrammatic illustration of an apparatus 50 and method for manufacturing the first example of the aerosol generating article 1 described above with reference to FIGS. 1 and 2 in which the second body 26 of aerosol forming material includes foam material 58.

The apparatus 50 comprises a first passage 54 through which a partially formed aerosol generating article 1 in the form of a continuous rod is transported in the direction of the arrows towards an opening 56 of a nozzle 52 which surrounds the partially formed article 1. The partially formed aerosol generating article 1 can be formed in any suitable manner by wrapping a first sheet of material around the first body of aerosol forming material 22 so that the longitudinally extending free edges of the first sheet overlap each other. As explained above, the first sheet of material is a metal wrapper and constitutes the first tubular member 24. An electrically conductive adhesive 30 can be applied to one or both of the overlapping edges of the metal wrapper to secure them together and to thereby form a closed electrical circuit around the first body of aerosol forming material 22 as described above with reference to FIGS. 1 and 2.

Foam material 58 is delivered through an annular second passage 60 in the nozzle 52 in the direction of the arrows to the nozzle opening 56 where the foam material 58 is ejected and positioned around the metal wrapper constituting the first tubular member 24 of the partially formed article 1. As explained above, the foam material 58 constitutes the second body 26 of aerosol forming material.

After positioning of the foam material 58 around the metal wrapper, a second sheet of material 68 is transported from a supply roll 62 via rollers 64, 66 and is wrapped around the foam material 58, for example at a wrapping station (not shown in FIG. 5). The second sheet of material 68 is a paper wrapper which, when wrapped around the foam material 58, constitutes the second tubular member 28.

A fully formed aerosol generating article 1 in the form of a continuous rod is thereby formed and can then be transported to a cutting station (not shown in FIG. 5) where it is cut at appropriate positions into predetermined lengths to form multiple aerosol generating articles 1. It will be understood that this type of method is suitable for the mass production of aerosol generating articles 1.

Figure 6:
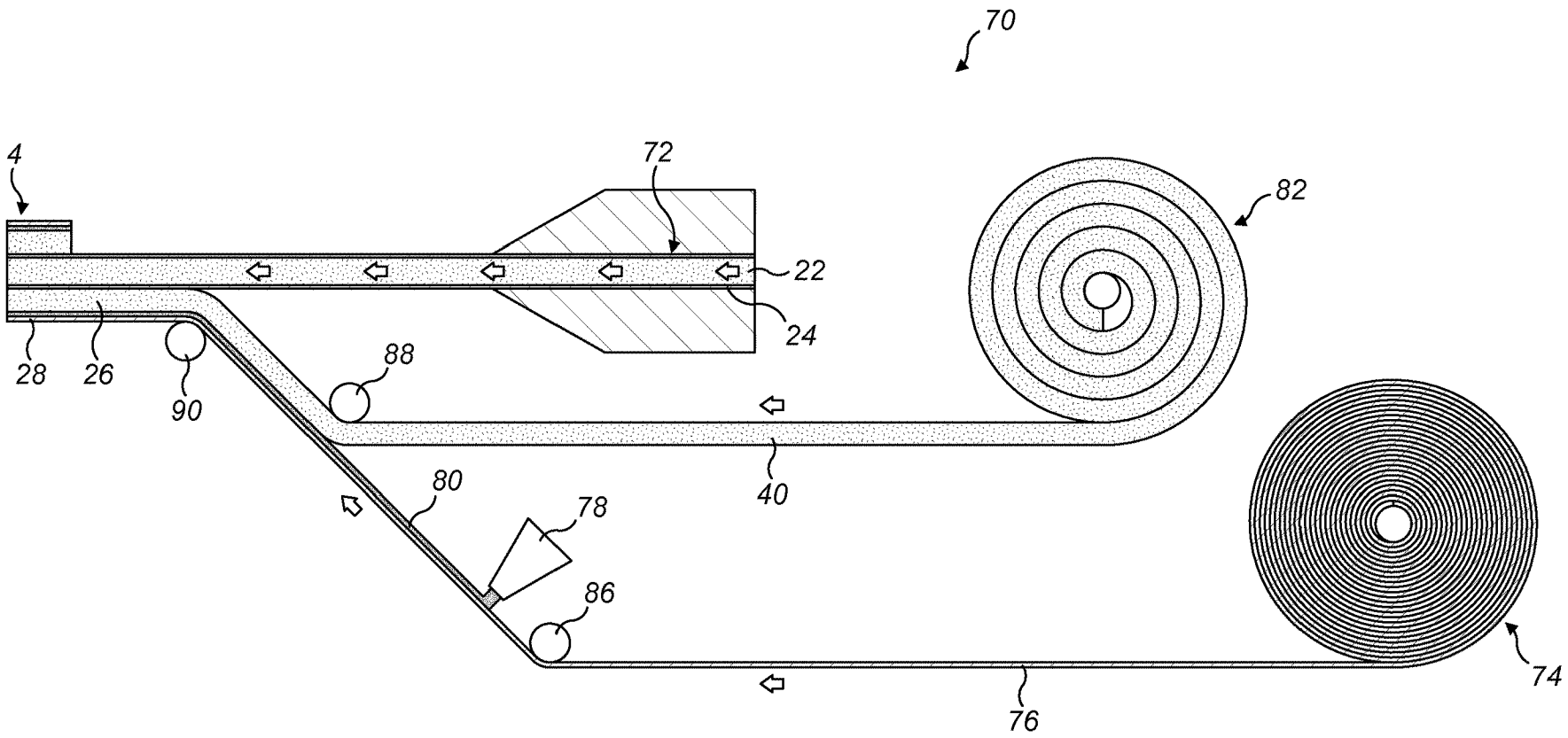
FIG. 6 is a diagrammatic illustration of an apparatus and method for manufacturing a fourth example of an aerosol generating article.

Referring now to FIG. 6, there is shown a diagrammatic illustration of an apparatus 70 and method for manufacturing a fourth example of an aerosol generating article 4 which is similar to the second example of the aerosol generating article 2 described above with reference to FIG. 3 and in which the second body 26 of aerosol forming material comprises a sheet 40 of aerosol forming material wrapped once around the first tubular member 24.

The apparatus 70 comprises a passage 72 through which a partially formed aerosol generating article 4 in the form of a continuous rod is transported in the direction of the arrows. The partially formed aerosol generating article 4 can be formed in any suitable manner by wrapping a sheet of material around the first body of aerosol forming material 22 so that the longitudinally extending free edges of the sheet overlap each other. As explained above, the sheet of material is a metal wrapper and constitutes the first tubular member 24. An electrically conductive adhesive 30 can be applied to one or both of the overlapping edges of the metal wrapper to secure them together and to thereby form a closed electrical circuit around the first body of aerosol forming material 22.

The apparatus 70 includes a first supply roll 74 containing a continuous sheet 76 of material in the form of a paper wrapper, an applicator 78, for example a nozzle, which applies a non-electrically conductive and non-magnetically permeable adhesive 80 to a surface of the continuous sheet 76 and a second supply roll 82 containing the sheet 40 of aerosol forming material.

As will be apparent from FIG. 6, the continuous sheet 76 of paper wrapper and the continuous sheet 40 of aerosol forming material are transported via rollers 86, 88, 90 to a wrapping station (not shown in FIG. 6) where they are wrapped around the metal wrapper constituting the first tubular member 24 to form a fully formed aerosol generating article 4 in the form of a continuous rod. Prior to wrapping the continuous sheet 76 of paper wrapper and the continuous sheet 40 of aerosol forming material around the metal wrapper constituting the first tubular member 24, the adhesive 80 is applied by the applicator 78 to a surface of the continuous sheet 76 of paper wrapper allowing the sheets 76, 40 to be adhered together. Thus, in the resulting aerosol generating article 4, it will be understood that at least part of the second body of aerosol forming material 26 that is constituted by the sheet 40 of aerosol forming material is adhered to the paper wrapper that constitutes the second tubular member 28.

It will again be understood that a fully formed aerosol generating article 4 in the form of a continuous rod is formed by the above method which can be transported to a cutting station (not shown in FIG. 6) where it is cut at appropriate positions into predetermined lengths to form multiple aerosol generating articles 4. Again, this type of method is suitable for the mass production of aerosol generating articles 4.

Referring now to FIG. 7, there is shown a diagrammatic illustration of a method for manufacturing a fifth example 5 of an aerosol generating article (FIG. 7*d*) which is similar to the aerosol generating articles described above and in which corresponding elements are designated using the same reference numerals.

Figure 7A:
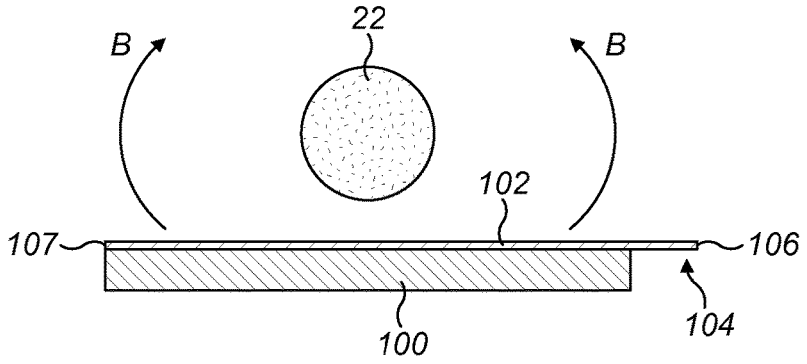
FIG. 7 is a diagrammatic illustration of a method for manufacturing a fifth example of an aerosol generating article.

In a first step shown in FIG. 7*a*, aerosol forming material 100, which may include powder, shreds, strands, porous material, foam material and sheets, is adhered to a first sheet 102 in the form of a metal wrapper, whilst leaving an exposed region 104 along an edge 106 of the first sheet 102.

Figure 7B:
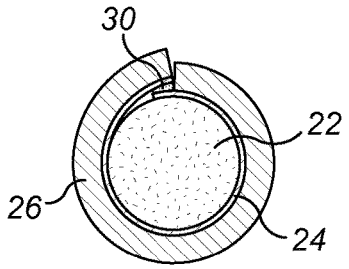

Both the first sheet 102 and the aerosol forming material 100 adhered thereto are then simultaneously wrapped around the first body of aerosol forming material in a second step, shown by the arrows B in FIG. 7*a*, to form a partially formed aerosol generating article as shown in FIG. 7*b* in which the wrapped first sheet 102 acts as the first tubular member 24 (metal wrapper) and the aerosol forming material 100 forms part of the second body 26 of aerosol forming material surrounding the metal wrapper. The overlapping edges of the first sheet 102 are secured together by an electrically conductive adhesive 30 which can be applied to the exposed region 104, along the edge 106, on the same surface of the first sheet 102 as the aerosol forming material 100 and/or along the opposite edge 107 of the first sheet 102 on the opposite surface to the aerosol forming material 100 before it is wrapped around the first body of aerosol forming material 22.

In a third step, a sheet of aerosol forming material 108 is adhered to a second sheet 110 in the form of a paper wrapper, whilst leaving an exposed region 112 along an edge 114 of the second sheet 110. The sheet of aerosol forming material 108 includes a plurality of longitudinally extending surface recesses 116 and a plurality of longitudinally extending and surface projections 118.

Figure 7C:
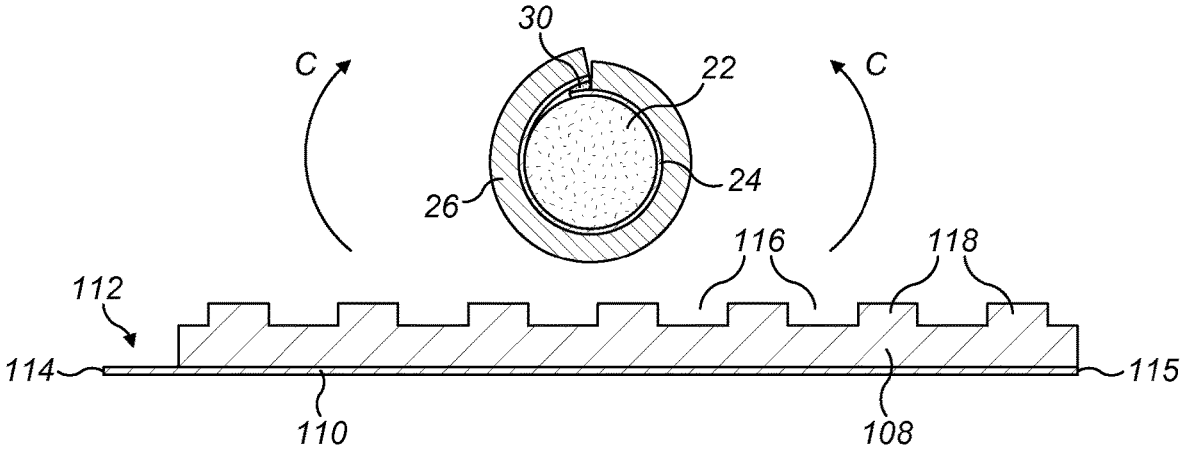
Figure 7D:
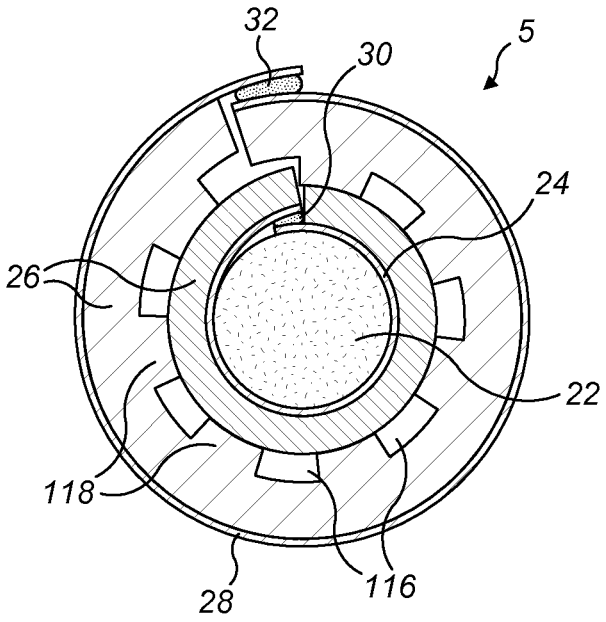

Both the second sheet 110 and the sheet of aerosol forming material 108 adhered thereto are then simultaneously wrapped around the second body of aerosol forming material 26 in a fourth step, shown by the arrows C in FIG. 7*c*, to complete the manufacture of the aerosol generating article 5 shown in FIG. 7*d* in which the wrapped second sheet 110 acts as the second tubular member (paper wrapper) and the sheet of aerosol forming material 108 forms part of the second body of aerosol forming material 26 surrounding the metal wrapper. The overlapping edges of the second sheet 110 are secured together by a non-electrically conductive and non-magnetically permeable adhesive 32 which can be applied to the exposed region 112, along the edge 114, on the same surface of the second sheet 110 as the sheet of aerosol forming material 108 and/or along the opposite edge 115 of the second sheet 110 on the opposite surface to the sheet of aerosol forming material 108 before it is wrapped around the second body of aerosol forming material 26.

Although exemplary embodiments have been described in the preceding paragraphs, it should be understood that various modifications may be made to those embodiments without departing from the scope of the appended claims. Thus, the breadth and scope of the claims should not be limited to the above-described exemplary embodiments.

Any combination of the above-described features in all possible variations thereof is encompassed by the present disclosure unless otherwise indicated herein or otherwise clearly contradicted by context.

Unless the context clearly requires otherwise, throughout the description and the claims, the words "comprise", "comprising", and the like, are to be construed in an inclusive as opposed to an exclusive or exhaustive sense; that is to say, in the sense of "including, but not limited to".

The invention claimed is:

1. An aerosol generating article comprising:

a first body of aerosol forming material;

a first tubular member surrounding the first body of aerosol forming material, the first tubular member being inductively heatable in the presence of a time varying electromagnetic field;

a second body of aerosol forming material surrounding the first tubular member;

a second tubular member surrounding the second body of aerosol forming material;

wherein the second body of aerosol forming material includes at least one sheet of aerosol forming material wrapped around the first tubular member and/or wherein the second body of aerosol forming material includes foam material and/or wherein at least part of the second body of aerosol forming material is adhered to the first tubular member and/or the second tubular member.

2. The aerosol generating article according to claim 1, wherein the at least one sheet of aerosol forming material includes one or more surface projections and/or one or more surface recesses to form an air flow path through the aerosol generating article.

3. The aerosol generating article according to claim 1, wherein the second body of aerosol forming material includes a plurality of layers between the first and second tubular members.

4. The aerosol generating article according to claim 3, wherein one of the layers is adhered to the first tubular member and another of the layers is adhered to the second tubular member.

5. A method for manufacturing the aerosol generating article according to claim 1 in which the first and second tubular members comprise first and second sheets respectively and the second body of aerosol forming material includes at least one sheet of aerosol forming material, the method comprising:

(i) wrapping the first sheet around the first body of aerosol forming material to form the first tubular member;

(ii) wrapping the at least one sheet of aerosol forming material around the first tubular member to form the second body of aerosol forming material; and (iii) wrapping the second sheet around the second body of aerosol forming material to form the second tubular member.

6. The method according to claim 5, wherein step (iii) is performed multiple times to provide a plurality of layers of the at least one sheet of aerosol forming material.

7. A method for manufacturing the aerosol generating article according to claim 1 in which the first and second tubular members comprise first and second sheets respectively, the method comprising:

(i) wrapping the first sheet around the first body of aerosol forming material to form the first tubular member;

(ii) wrapping the second body of aerosol forming material around the first tubular member; and (iii) wrapping the second sheet around the second body of aerosol forming material to form the second tubular member;

wherein at least part of the second body of aerosol forming material is adhered to the first sheet and/or the second sheet.

8. The method according to claim 7, wherein the second body of aerosol forming material is adhered to the second sheet, and wherein steps (ii) and (iii) are performed simultaneously to wrap the second sheet and second body of aerosol forming material adhered thereto around the first tubular member so that the second body of aerosol forming material is positioned between the first and second tubular members.

9. The method according to claim 7, wherein the second body of aerosol forming material is adhered to the first sheet, and wherein steps (i) and (ii) are performed simultaneously to wrap the first sheet and second body of aerosol forming material adhered thereto around the first body of aerosol forming material so that the first tubular member contacts the first body of aerosol forming material.

10. The method according to claim 7, wherein the second body of aerosol forming material includes at least one sheet of aerosol forming material.

11. The method according to claim 7, wherein the method comprises, prior to steps (ii) and (iii), positioning the second body of aerosol forming material on the second sheet.

12. The method according to claim 11, further comprising leaving an exposed region along an edge of the second sheet to allow the exposed region to be connected to an opposite edge of the second sheet during step (iii).

13. The method according to claim 7, wherein the method comprises, prior to step (i), positioning the second body of aerosol forming material on the first sheet.

14. The method according to claim 13, further comprising leaving an exposed region along an edge of the first sheet to allow the exposed region to be connected to an opposite edge of the first sheet during step (i).

15. A method for manufacturing the aerosol generating article according to claim 1 in which the first and second tubular members comprise first and second sheets respectively and the second body of aerosol forming material includes foam material, the method comprising:

(i) wrapping the first sheet around the first body of aerosol forming material to form the first tubular member;

(ii) positioning the foam material around the first tubular member; and (iii) wrapping the second sheet around the foam material to form the second tubular member.

16. The method according to claim 15, wherein step (ii) comprises ejecting the foam material from an opening of a nozzle surrounding the first tubular member formed by wrapping the first sheet in step (i).

17. The method according to claim 16, wherein the first tubular member moves in its longitudinal direction from an inside to an outside of the nozzle through the opening during ejection of the foam material from the opening.

* * * * *